US005197627A

United States Patent [19]

Disabato et al.

[11] Patent Number: 5,197,627

[45] Date of Patent: Mar. 30, 1993

[54] DOUBLE WALLED STORAGE TANK

[75] Inventors: Dan M. Disabato, St. Louis; James E. Davis, Pacific, both of Mo.

[73] Assignee: Petrolite Corporation, St. Louis, Mo.

[21] Appl. No.: 666,828

[22] Filed: Mar. 8, 1991

[51] Int. Cl.[5] ..... B65D 90/04

[52] U.S. Cl. ..... 220/571; 220/469; 220/4.12

[58] Field of Search ..... 220/469, 571, 4.12, 220/1.5, 694

[56] References Cited

U.S. PATENT DOCUMENTS 4,982,871 1/1991 Kiecker et al. ..... 220/469
5,052,582 10/1991 Hall ..... 220/571
5,071,166 12/1991 Marino ..... 220/469
5,072,623 12/1991 Hendershot ..... 220/469

*Primary Examiner*—Joseph Man-Fu Moy
*Attorney, Agent, or Firm*—Kenneth Solomon; Joseph M. Rolnicki

[57] ABSTRACT

A double walled tank is provided for the storage of hazardous materials. The tank comprises an internal tank substantially contained inside an external tank, and substantially reduces the use of internal reinforcements between the two tanks that would disrupt the flow of fluids through the interiors of the tanks. The tank is also provided with a pair of spill boxes that surround access openings to the double walled tank and catch and contain any hazardous material that should leak or spill when loading or unloading the tank.

13 Claims, 2 Drawing Sheets

FIG. 1.
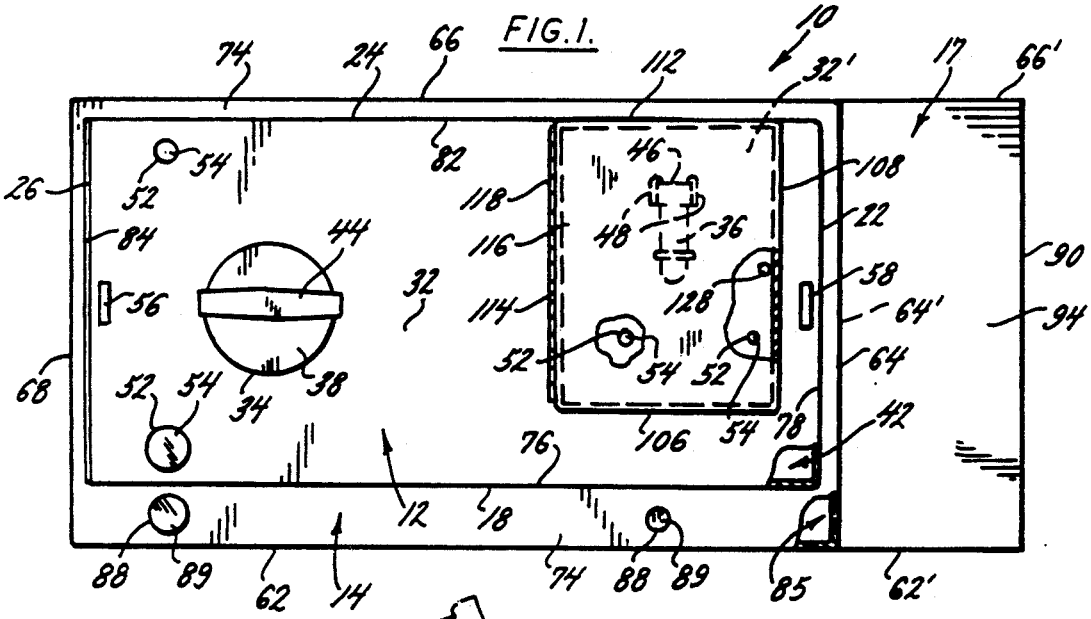
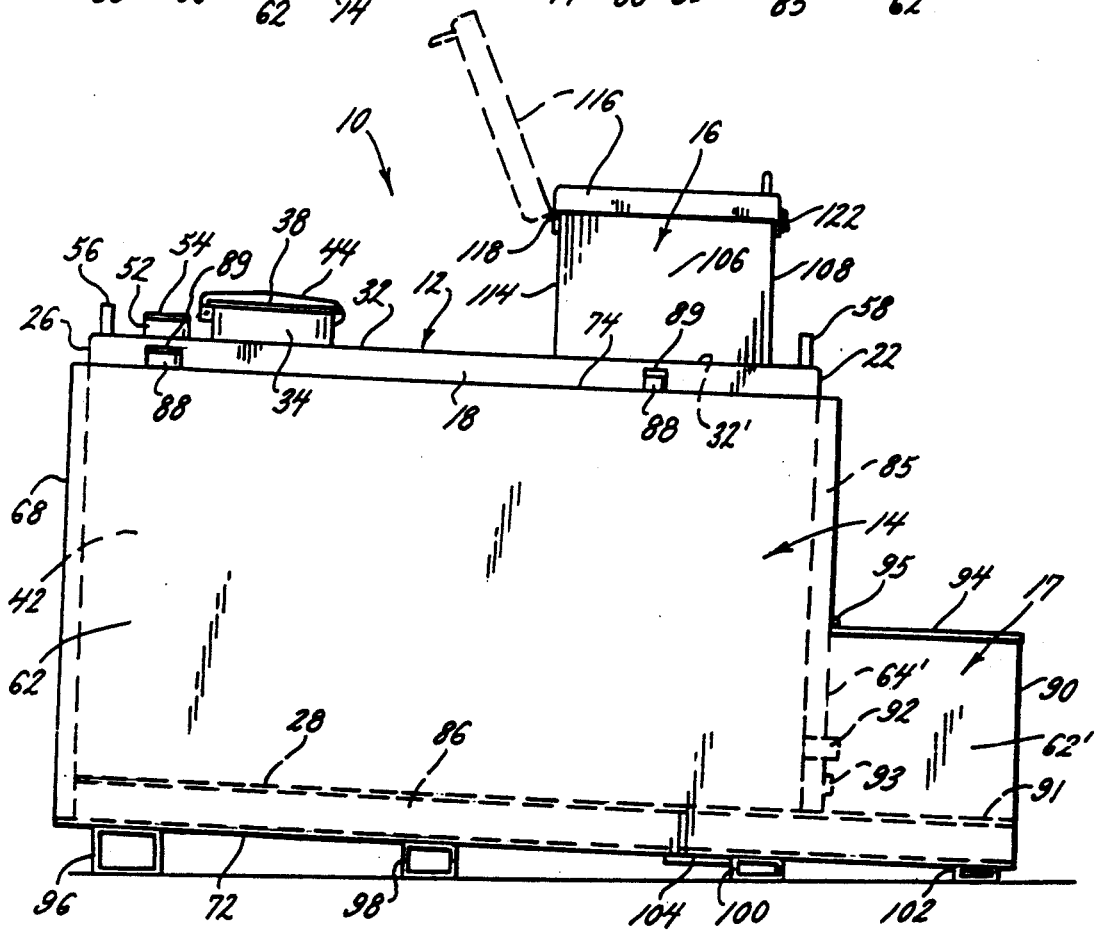
FIG. 2.

FIG. 3.
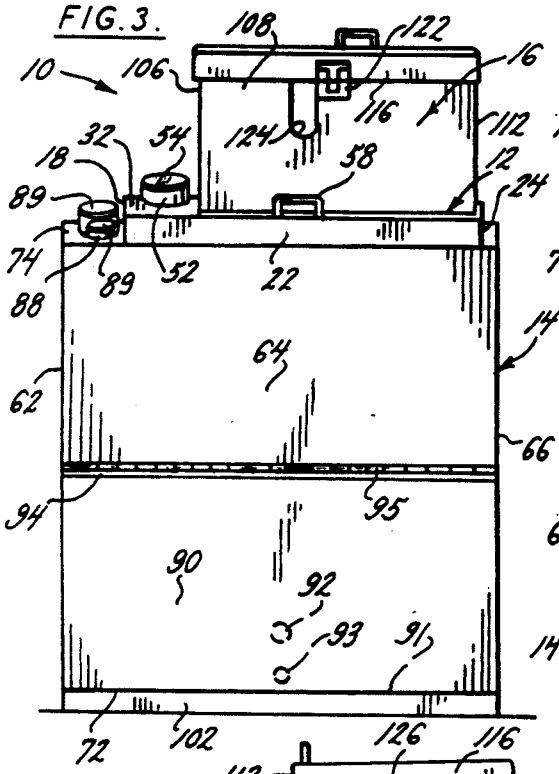
FIG. 4.
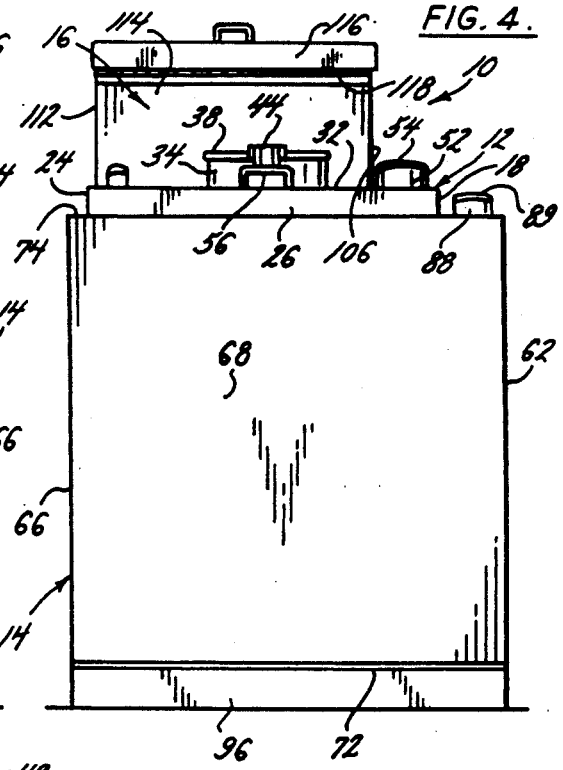
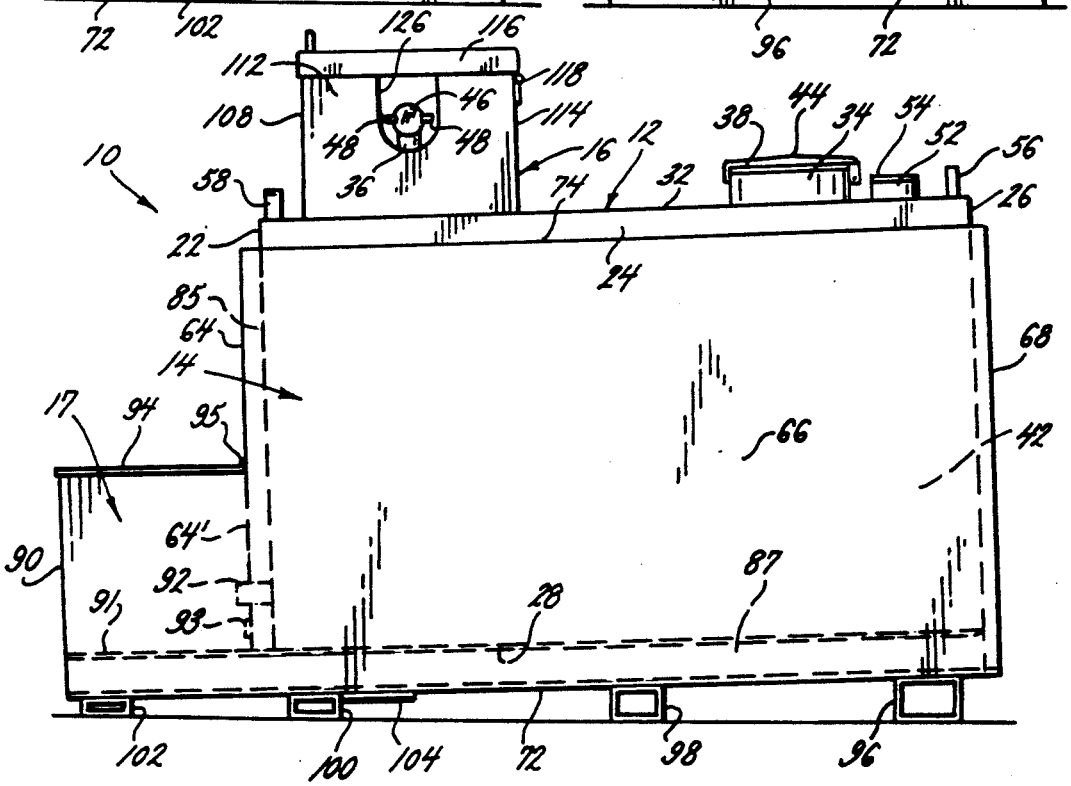
FIG. 5.

DOUBLE WALLED STORAGE TANK

BACKGROUND OF THE INVENTION (1) Field of the Invention

The present invention relates to a double walled storage tank. In particular, the present invention relates to a double walled storage tank primarily intended for the storage of hazardous materials. The tank comprises an internal tank substantially contained inside an external tank. A minimum number of internal supports are provided between the internal tank and the interior of the external tank to avoid interfering with the free flow of fluid through the interior of the external tank. The tank also comprises a pair of spill boxes. One spill box surrounds an access opening to the double walled tank and catches and retains any hazardous material that should spill when loading or unloading the tank through the access opening. A second spill box serves as a pump housing and catches and retains any hazardous material that should leak from the pump or the pump's fluid connection with the internal tank.

(2) Description of the Related Art

Prior art double walled tanks often comprise a first tank that is supported in the interior of a second tank by reinforcement members that are connected between the exterior wall of the first tank and the interior wall of the second tank. The reinforcement members are required to support the first tank inside the second tank in a spaced relation with the bottom of the first tank being supported above the bottom of the second tank. This particular type of construction is employed so that if any materials should leak from the first tank, they will be contained inside the second tank.

Prior art double walled tanks are also often constructed with the external tank having a sloped bottom wall. Should fluid leak from the first tank, it will gravitate over the bottom wall of the second tank and collect in an area of the second tank where a drain output is provided.

However, prior art double walled tanks employing reinforcements between the first internal tank and the second external tank are disadvantaged in that the reinforcements will often disrupt the free flow of fluid over the bottom wall of the external tank to the drain collection area. This is especially true in double walled tanks employing reinforcements that extend across the path of fluid flow to the drain collection areas of the tanks. This presents the possibility that hazardous materials that happen to leak from the internal tank will collect in areas of the external tank where the reinforcements prevent the free flow of fluid to the drain collection areas.

Prior art double walled tanks also often have pumps that communicate with the internal tank and several access openings in the tank for inputting materials into the internal tank or drawing materials out of the tank. The access openings are often provided with lids or caps that seal off access to the materials stored in the tank. With tanks employed in storing hazardous materials, very often the caps or lids that close the access openings of the tank are provided with locking mechanisms that prevent the unauthorized access to the hazardous materials contained in the tank. However, the pump connections and access openings of prior art storage tanks have been found to be disadvantaged in that, should hazardous materials leak from the pump connection or spill from the access openings when being input to the tank or drawn from the tank, prior art tanks provide no way of controlling or containing the leak or spill and preventing their spreading to other areas of the tank.

SUMMARY OF THE INVENTION

The double walled tank of the present invention is generally comprised of an internal tank, an external tank for the most part surrounding the internal tank, a plurality of access openings in the top surfaces of the internal and external tanks, and a pair of spill boxes surrounding a pump connection and several of the access openings on the top surface of the internal tank.

The internal tank has a rectangular box-like configuration with four side walls, a bottom wall and a top wall or top surface. Several access openings are provided in the top surface of the internal tank including a manway and a fill pipe, each of which are provided with a releasable lid closure and cap closure respectively.

One spill box of the pair is provided on the top surface of the internal tank. The spill box includes four side walls that are arranged in a rectangular configuration. Each of the four side walls are secured to the top surface of the internal tank and project vertically upward from the tank. The side walls surround the fill pipe, and a hinge door of the spill box closes over a top opening of the box to completely enclose the fill pipe.

The internal tank is predominantly surrounded by the external tank. The external tank is comprised of four side walls, a bottom wall, and a top wall or top surface. Portions of the four side walls of the internal tank and the top surface of the internal tank project upward through the top surface of the external tank. The top surface of the external tank is secured around the portions of the internal tank side walls and suspends the internal tank inside the external tank. Each of the four side walls of the external tank are spaced from the side walls of the internal tank and the bottom wall of the internal tank is suspended above the bottom wall of the external tank. A pair of parallel channel members are provided between the bottom wall of the internal tank and the bottom wall of the external tank. The channel members provide added support to the internal tank. Several access openings in the top surface of the external tank provide access to the interior volume of the external tank between the side walls and bottoms of the external tank and the internal tank.

The second spill box of the pair is provided on one of the side walls of the external tank. A bottom wall of the spill box is supported above the bottom wall of the external tank by the pair of channel members. A fluid conduit is provided between the spill box and the internal tank for connection with a pump contained in the spill box. A drain hole communicating the spill box with the interior of the external tank extends through the side wall of the external tank to which the spill box is attached. The drain hole is positioned about 2 inches above the bottom wall of the spill box to cause small pump leaks to collect in the spill box, and cause larger leaks to drain through the hole and into the external tank.

Four elevating supports are provided beneath the bottom wall of the external tank and the pump spill box. The elevating supports elevate the tank and are spacially arranged along the bottom of the tank so that the tank may be lifted and transported by a fork lift truck. Each of the four elevating supports have different vertical dimensions so that they support the tank at an angle to the horizontal. The elevating supports cause the tank to slope toward the side wall of the tank adjacent the pump spill box so that liquid collected in the interiors of each of the internal and external tanks will gravitate toward and collect at the one side of the tank where it can be easily drained.

The tank is preferably constructed from metal sheet welded together to form the component parts of the tank. The welds provide fluid tight connections between the tank's component parts that are also sufficiently strong to support the weight of the tank and the materials it contains.

BRIEF DESCRIPTION OF THE DRAWINGS

Further objects and features of the present invention are revealed in the following detailed description of the preferred embodiment of the invention and in the drawings figures wherein:

FIG. 1 is a plan view of the double walled tank of the invention;

FIG. 2 is an elevation view of the front of a double walled tank;

FIG. 3 is an elevation view of one side of the double walled tank;

FIG. 4 is an elevation view of a second side of the double walled tank; and

FIG. 5 is an elevation view of the back of the double walled tank.

DESCRIPTION OF THE PREFERRED EMBODIMENT

A front view of the double walled tank 10 of the present invention is shown in FIG. 2. The double walled tank is generally comprised of an internal tank 12, an external tank 14 that, for the most part, completely surrounds the internal tank 12, and a pair of spill boxes 16, 17 provided on the top and side of the tank. The tank is preferably constructed from metal sheet welded together to form each of the individual component parts of the tank. The welds provide fluid tight connections between the tank's component parts that are sufficiently strong to support the weight of the tank and the materials the tank contains.

The internal tank 12 has a general rectangular, box-like configuration with four side walls 18, 22, 24, 26, a bottom wall 28, and a top wall or top surface 32. Although the rectangular configuration of the tank is preferred, the tank may also be constructed having a spherical or cylindrical configuration, or some other geometric configuration.

Several access openings are provided in the top surface 32 of the internal tank including a manway 34 and a fill pipe 36. The manway 34 is provided with a releasable lid closure 38. The lid closure 38 is pivotally connected to the manway 34 and is capable of being pivoted between a first, closed position where it prevents access to the interior 42 of the internal tank 12, and a second, open position where it permits access to the interior 42 of the internal tank. A locking mechanism 44 is provided with the lid closure 38 so that the lid may be locked in its closed position over the access opening of the manway 34. The fill pipe 36 is provided with a cap closure 46 that is screw threaded over the end of the fill pipe to prevent access to the interior of the internal tank 12 through the fill pipe. The cap closure 46 is removed from the end of the fill pipe 36 to permit the attachment of a hose to the end of the fill pipe to either drain fluid from the interior of the internal tank 12 or to supply fluid to the interior of the tank. Locking mechanisms 48 are provided on the sides of the fill pipe to attach and securely hold a hose over the end of the pipe.

Additional access openings or ports 52 are provided in the top surface 32 of the internal tank 12. These additional ports are sealed by plugs 54 when not in use. A pair of lifting lugs 56, 58 are secured at opposite ends of the internal tank top surface 32. The lifting lugs are provided to enable lifting the tank by pulleys or a crane when transporting the tank.

The external tank 14 predominantly surrounds the internal tank 12. Like the internal tank, the external tank is comprised of four side walls 62, 64, 66, 68, a bottom wall 72, and a top wall or top surface 74. The external tank may also be constructed with some alternate geometric configuration to match the internal tank. As can be seen in the drawing figures, the top surface 32 and portions of the four side walls 18, 22, 24, 26 of the internal tank project through the top surface 74 of the external tank. A rectangular opening in the top surface 74 of the external tank is configured with four side edges 76, 78, 82, 84 that are secured by fluid tight welds to the four side walls 18, 22, 24, 26 of the internal tank, respectively. The welds between the four edges of the opening in the external tank top surface 74 and the four side walls of the internal tank 12 serve to suspend the internal tank 12 inside the interior volume 85 of the external tank 14. A pair of channel members 86, 87 are also provided between the bottom wall 28 of the internal tank and the bottom wall 72 of the external tank. The channel member provide additional support for the internal tank inside the external tank. The channel members are laterally spaced and run the longitudinal length of the tank from left to right as shown in FIGS. 2 and 5. The minimum number of channel members and their lateral spacing prevents the channel members from interfering with the free flow of fluid through the external tank.

The four side walls 18, 22, 24, 26 and the bottom wall 28 of the internal tank 12 are spaced from the interior surfaces of the four side walls 62, 64, 66, 68 and the bottom wall 72 of the external tank. By limiting the interior connections between the side walls and bottom wall of the internal tank and the internal surfaces of the side walls and bottom wall of the external tank, any fluid that happens to leak from the interior of the internal tank into the interior of the external tank is permitted to flow freely through the interior of the external tank and gravitate toward a drain collection point.

A second plurality of access openings 88 are provided in the top surface 74 of the external tank 14. The second plurality of access openings 88 provide access to the interior volume 85 of the external tank 14 between the interior surfaces of the side walls and bottom of the external tank and the exterior surfaces of the side walls and bottom of the internal tank. Like several of the first plurality of access openings provided in the top surface of the internal tank, the second plurality of access openings 88 are sealed by removable plugs 89.

One of the pair of spill boxes 17 is provided on the right side of the external tank 14 as viewed in FIGS. 1 and 2. The spill box is rectangular and includes four side walls 62', 64', 66', 90 and a bottom wall 91 that are arranged in the configuration of an open-top box. As seen in the drawing figures, three of the spill box side walls 62', 64', 66' are extensions of three of the side walls 62, 64, 66 of the external tank 14. The four side walls and the bottom wall of the spill box are all welded in fluid tight connections to each other.

A fluid conduit 92 extends from a side wall 22 of the internal tank 12, through the side wall 64' of the spill box 17, and into the spill box interior. The fluid conduit 92 is provided for connection with a pump (not shown) contained inside the spill box 17. Connecting a pump to the conduit 92 establishes fluid communication between the pump (not shown) contained in the spill box 17 and the fluid contained in the interior of the internal tank 12.

A drain opening 93 is provided through the spill box side wall 64' just below the fluid conduit 92. The drain opening 93 is positioned about 2 inches above the bottom wall 91 of the spill box. The drain opening 93 communicates the interior of the spill box 17 with the internal volume of the external tank 14.

A lid closure 94 selectively opens and closes the top opening of the pump spill box 17. The lid 94 is pivotally connected to the side wall 64 of the external tank 14 by a hinge 95. The lid may also be provided with a locking mechanism (not shown) that secures the lid in its closed position over the top opening of the pump spill box 17 and prevents access to the interior of the spill box.

The pump spill box 17 provides a way of containing any leakage of materials that may occur from a pump (not shown) contained in the spill box 17 or from the conduit 92 communicating the pump with the internal tank 12. Any material that should leak from the pump or the conduit 92 will collect on the spill box bottom wall 91 and will be contained inside the four side walls 62', 64', 66', 90 of the spill box. Any leaking materials will accumulate in the interior of the pump spill box 17 until the materials reach the height of the drain hole 93. Once leaking materials accumulate to this height, any additional leakage will flow through the drain hole 93 and begin to collect in the volume inside the interior of the external tank 14 and outside the walls of the internal tank 12. In this manner, any minor leakage from the pump or conduit 92 is contained in the bottom of the pump spill box 17. Should excessive leakage of the pump or conduit 92 occur, the pump spill box 17 will not overflow, but will drain through the drain hole 93 into the interior volume of the external tank 14.

Four elevating supports 96, 98, 100, 102 are secured to the underside of the external tank bottom wall 72. The four elevating supports extend laterally across the bottom wall 72 of the external tank between the front and back walls 62, 66 of the tank. As is best seen in FIGS. 2 and 5, the elevating supports 96, 98, 100, 102 are spacially arranged along the bottom of the tank to permit insertion of forks of a lift truck between the supports and underneath the tank. As is also visible in FIGS. 2 and 5, each of the four elevating supports 96, 98, 100, 102 have different vertical dimensions and support the tank at an angle to the horizontal. The differing vertical dimensions of the supports cause the tank to slope toward the pump spill box 17. The slanting of the tank toward the spill box causes liquids collected in the interiors of the internal and external tanks to gravitate toward the one side wall 22 of the internal tank and the side wall 90 of the external tank and pump spill box 17. The liquids collect in these areas where they can be easily drawn off by the pump (not shown) or drained through a drain opening (not shown).

A reinforcing lifting pad 104 is provided on the underside 72 of the external tank adjacent the elevating support 100. The lifting pad 104 is provided to be engaged by a fork of a fork lift truck employed in lifting and transporting the tank. The lifting pad 104 reinforces the bottom wall 72 of the external tank in an area where one fork of the lifting truck will engage the pad and lift the tank to a horizontal orientation prior to both forks of the lifting truck engaging the tank bottom wall 72 and lifting the tank.

The second spill box 16 is provided on the top surface 32 of the internal tank 12. Preferably, the spill box is rectangular and includes four side walls 106, 108, 112, 114 that are arranged in the configuration of an open top box. In alternate embodiments of the invention, the spill box may have a cylindrical or other geometric configuration. The four side walls 106, 108, 112, 114 of the spill box are each welded in fluid tight connections to the top surface 32 of the internal tank.

A lid closure 116 selectively opens and closes the top opening of the spill box 16. The lid 116 is pivotally connected to a back side wall 114 of the spill box by a hinge 118. The lid is also provided with a locking mechanism 122 that secures the lid in the closed position over the top opening of the spill box and prevents access to the interior of the spill box.

As is best seen in FIG. 1, the four side walls of the spill box 16 completely surround the fill pipe 36. The spill box side walls also surround several of the additional access ports 52 provided in the top surface 32 of the internal tank, and also surround a portion 32' of the top surface of the tank. By locking the lid 116 of the spill box in its closed position over the top opening of the box, access is denied to the fill pipe 36 and the other access openings 52 enclosed in the spill box.

A pair of notch openings 124, 126 are provided through two of the side walls 108, 112, of the spill box. The notch openings are provided to enable the insertion of a hose or other fluid conduit through one of the notch openings and attachment of the conduit to one of the access openings of the internal tank surrounded by the spill box. For example, a hose or fluid conduit can be passed through the spill box notch 124 and the access opening 52 provided in the top surface 32 of the internal tank to communicate the conduit with the fluid contained inside the internal tank. A hose or fluid conduit may also be passed through the notch 126 provided in the side wall 112 of the spill box and connected to the end of the fill pipe 36 to supply fluid to the internal tank 12 through the fill pipe. Each of these connections can be established with the lid 116 of the spill box open, and then the spill box lid may be closed and locked in position covering the opening of the spill box to prevent further access to the interior of the box.

The spill box 16 provides a way of containing any spillage of materials that may occur when supplying the materials to or draining the materials from the internal tank 12. For example, any spillage that may occur when connecting a hose to the fill pipe 36 will be contained inside the four side walls of the spill box 16 and will not spread out over the exterior of the tank. A drain hole 128 is provided through the top surface 32 of the internal tank adjacent one of the side walls 108 of the spill box 18. Due to the sloping of the tank caused by the elevating supports 96, 98, 100, 102, any spillage of materials inside the spill box will gravitate toward the one side wall 108 of the box and toward the drain 128 adjacent this side wall. This causes the spillage to reenter the interior 42 of the internal tank 12 through the drain hole 128. The additional access openings or ports 52 provided in the top surface 32 of the internal tank and enclosed by the spill box 16 are provided for venting the tank interior.

While the present invention has been described by reference to a specific embodiment, it should be understood that modifications and variations of the invention may be constructed without departing from the scope of the invention defined in the following claims.

What is claimed is:

1. A container for storage of materials, the container comprising:

a tank assembly having double walls and a top surface;

an access opening through the top surface, the access opening providing access to an interior volume of the tank assembly;

a first spill box secured to the top surface, the first spill box having at least one wall surrounding the access opening and defining an interior of the first spill box;

a second spill box secured to one side of the tank assembly, the second spill box having at least one side wall defining an interior of the second spill box; and, a communication means extending between the tank assembly and the second spill box and providing fluid communication between the interior volume of the tank assembly and the interior of the second spill box.

2. The container of claim 1, wherein:

a manway is provided through the top surface of the tank assembly, the manway being outside the spill box.

3. The container of claim 1, wherein:

the tank assembly includes a first internal tank having a first top surface and a second external tank having a second top surface, the internal tank being predominantly enclosed inside the external tank with the top surface of the internal tank projecting through the top surface of the external tank.

4. The container of claim 1, wherein:

the access opening is provided with a first closure means to open and close the access opening and thereby provide access to the interior volume of the tank assembly and prevent access to the interior volume of the tank assembly, respectively; and the spill box is provided with a second closure means to open and close the spill box and thereby provide access to the interior of the spill box and prevent access to the interior of the spill box, respectively.

5. The container of claim 1, wherein:

the tank assembly is provided with a plurality of elevating supports spatially arranged beneath the tank assembly and elevating the tank assembly.

6. The container of claim 5, wherein:

each of the elevating supports is dimensioned differently and together the plurality of elevating supports tilt the tank assembly to one side of the tank assembly.

7. A container for storage of materials, the container comprising:

an external tank having a top surface;

an internal tank having a top surface, the internal tank being predominantly enclosed inside the external tank with the top surface of the internal tank projecting through the top surface of the external tank;

an access opening in the top surface of the internal tank providing access to an interior volume of the internal tank; and a spill box secured to the top surface of the internal tank surrounding the access opening.

8. The container of claim 7, wherein:

the spill box has at least one wall secured to the top surface of the tank surrounding the access opening, the wall also surrounding a portion of the top surface in an area around the access opening.

9. The container of claim 7, wherein:

the spill box has at least one wall secured to the top surface of the tank, the wall surrounding the access opening and defining an interior volume of the spill box;

the access opening is provided with a first closure means to open and close the access opening and thereby provide access to the interior volume of the tank and prevent access to the interior volume of the tank, respectively; and the spill box is provided with a second closure means to open and close the spill box and thereby provide access to the interior of the spill box and prevent access to the interior of the spill box, respectively.

10. The container of claim 7, wherein:

a second spill box is secured to one side of the external tank, the second spill box has an interior volume that communicates with the interior volume of the internal tank.

11. The container of claim 7, wherein:

the internal tank is secured to the top surface of the external tank and is suspended in the external tank solely by the top surface of the external tank.

12. The container of claim 7, wherein:

the internal tank includes at least one side wall and a bottom wall, and the external tank includes at least one side wall and a bottom wall that are spaced from the side wall and bottom wall of the internal tank.

13. A container for storage of materials, the container comprising;

an external tank having a top wall, at least one side wall, and a bottom wall;

an internal tank having a top wall, at least one side wall, and a bottom wall;

the internal tank being predominantly contained in the external tank with the top wall and portions of the at least one side wall of the internal tank projecting through the top wall of the external tank, and the top wall of the external tank being secured to the at least one side wall of the internal tank;

the internal tank encloses a first interior volume of the container and the external tank encloses a second interior volume of the container, and the at least one side wall and bottom wall of the internal tank separate the first interior volume from the second interior volume; and a spill box is secured to the external tank, the spill box has an interior volume, a first communication means extends between the internal tank and the spill box and communicates the first interior volume of the container with the interior volume of the spill box, and a second communication means extends between the external tank and the spill box and communicates the second interior volume of the container with the interior volume of the spill box.

* * * * *